US006669116B2

(12) United States Patent
Iwase

(10) Patent No.: US 6,669,116 B2
(45) Date of Patent: Dec. 30, 2003

(54) ORIFICE PLATE

(75) Inventor: Satoru Iwase, Obu (JP)

(73) Assignee: Aisan Kogyo Kabushiki Kaisha, Obu (JP)

( * ) Notice: Subject to any disclaimer, the term of this patent is extended or adjusted under 35 U.S.C. 154(b) by 0 days.

(21) Appl. No.: 10/360,938

(22) Filed: Feb. 10, 2003

(65) Prior Publication Data

US 2003/0164412 A1 Sep. 4, 2003

(30) Foreign Application Priority Data

Mar. 4, 2002 (JP) ..... 2002-057644

(51) Int. Cl.[7] ..... F02M 61/00; B05B 1/34

(52) U.S. Cl. ..... 239/533.12; 239/533.2; 239/533.14; 239/552; 239/554; 239/555; 239/585.1

(58) Field of Search ..... 239/533.12, 533.14, 239/552, 554, 555, 596, 533.2, 585.1; 29/890.142

(56) References Cited

U.S. PATENT DOCUMENTS 4,923,169 A * 5/1990 Grieb et al. ..... 251/118
4,934,653 A * 6/1990 Grieb et al. ..... 251/118
5,899,390 A * 5/1999 Arndt et al. ..... 239/553
5,924,634 A * 7/1999 Arndt et al. ..... 239/553
6,168,099 B1 * 1/2001 Hopf et al. ..... 239/596
6,357,677 B1 * 3/2002 Ren et al. ..... 239/585.4
2002/0092930 A1 * 7/2002 Itatsu ..... 239/533.3

FOREIGN PATENT DOCUMENTS

JP 10-18943 1/1998

* cited by examiner

*Primary Examiner*—Robin O. Evans
(74) *Attorney, Agent, or Firm*—Oliff & Berridge, PLC

(57) ABSTRACT

An orifice plate 21 is attached at the tip of an injector 1 to cover a fuel passage hole 18. The orifice plate 21 is provided with a plurality of orifices 24 for allowing fuel having passed through the fuel passage hole 18 to be injected. The orifice plate 21 includes a plate body 23 constructed in layers, and each orifice 24 is constructed of a plurality of holes 27*a*–27*d* each formed in each layer of the plate body 23 so that each hole is perpendicular to a surface of the plate body 23, the holes being disposed in communication with each other and with displacements from each other along a line obliquely intersecting the plate body.

8 Claims, 13 Drawing Sheets

ORIFICE PLATE

BACKGROUND OF THE INVENTION

1. Field of the Invention

The present invention relates to an injector to be used for fuel injection in an engine. More specifically, the present invention relates to an orifice plate disposed at the tip of the injector and used for setting characteristics of fuel injection.

2. Description of Related Art

An electromagnetic injector conventionally used for fuel injection in an engine is typically provided with a seat part at the tip of a nozzle body to cover a valve body formed at the tip of a needle valve from the tip. This seat part is provided with a fuel passage hole, to the tip of which a thin orifice plate having a plurality of orifices (small pores) is attached. Fuel having passed through the fuel passage hole is injected at a predetermined injection angle through those orifices.

Regarding the injector (fuel injection valve) including the above kind of orifice plate, the applicant of the present application has proposed a technique capable of prompting fuel atomization in Japanese patent unexamined publication No. 10-18943.

As shown in FIG. 15, the injector disclosed in the above publication includes a valve body 70*a* having a conical shape at the tip of a needle valve 70. At the tip of a nozzle body 71, a fuel passage hole 72 is formed. Around the fuel passage hole 72, there is formed a seat part 71*a* on which the valve body 70*a* is seated for a valve closed time. Two orifice plates 73 and 74 are fixedly superposed one on top of the other at the tip of the nozzle body 71 to cover the fuel passage hole 72 from the front side (the lower side in FIG. 15). These orifice plates 73 and 74 are provided with a plurality of orifices 73*a* and 74*a*, respectively, punched in positions within the fuel passage hole 72. These orifices 73*a* and 74*a*, as shown in FIG. 16, are formed each having a central axis C1, C2, C3, or C4 at an angle with a central axis O of the fuel passage hole 72 so that each distance between the axes C1 and C2 and between the axes C3 and C4 is widened downward. Thus, the orifices 73*a* and 74*a* are formed inclining to be oblique to each surface of the orifice plates 73 and 74. These orifices 73*a* and 74*a* are arranged in corresponding positions in the two orifice plates 73 and 74 respectively and have an equal inner diameter. The orifices 73*a* and 74*a* being inclined as above have stepped parts 75 on a superposed surface, namely, a joint portion between the orifices 73*a* and 74*a*. By this stepped part 75, the fuel flow passage provided by the orifices 73*a* and 74*a* is narrowed at the joint portion between the orifices 73*a* and 74*a* in a fuel injecting direction. Fuel to be sprayed will therefore impinge upon the stepped parts 75, so that the flow of fuel becomes turbulent. This turbulent fuel is utilized to prompt atomization of the fuel to be injected.

However, the orifice plates 73 and 74 of the conventional injector disclosed in the above publication need manufacturing to have the inclined orifices 73*a* and 74*a*, which would make it difficult to machine the plates 73 and 74 with accuracy. This conventional technique, in addition, requires forming of a plurality of orifices 73*a* or 74*a* inclined in different directions in each single orifice plate 73 and 74, as shown in FIG. 17. This would increase the number of machining steps due to punching of the orifices 73*a* and 74*a*, leading to a problem of productivity.

SUMMARY OF THE INVENTION

The present invention has been made in view of the above circumstances and has an object to overcome the above problems and to provide an orifice plate which can facilitate machining for providing an inclination to fuel to be injected through an orifice.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the purpose of the invention, there is provided an orifice plate which is mounted at a tip of an injector to cover a fuel passage hole formed at the tip, the orifice plate including: a plate body constructed in layers; and an orifice for allowing fuel having passed through the fuel passage hole to be injected; wherein the orifice is constructed of a plurality of holes each formed in each layer of the plate body so that each hole is perpendicular to a surface of the plate body, the holes being disposed in communication with each other and with displacements from each other along a line obliquely intersecting the plate body.

According to another aspect of the invention, there is provided an injector provided with the orifice plate described above, wherein the injector includes a plate holder provided with an injection hole, and the orifice plate is fixedly pressed against the tip of the injector by means of the plate holder and the orifice is positioned within the injection hole.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention.

In the drawings.

DETAILED DESCRIPTION OF THE PREFERRED EMBODIMENTS

A detailed description of a preferred embodiment of an orifice plate and an injector using the orifice plate embodying the present invention will now be given referring to the accompanying drawings.

Figure 1:
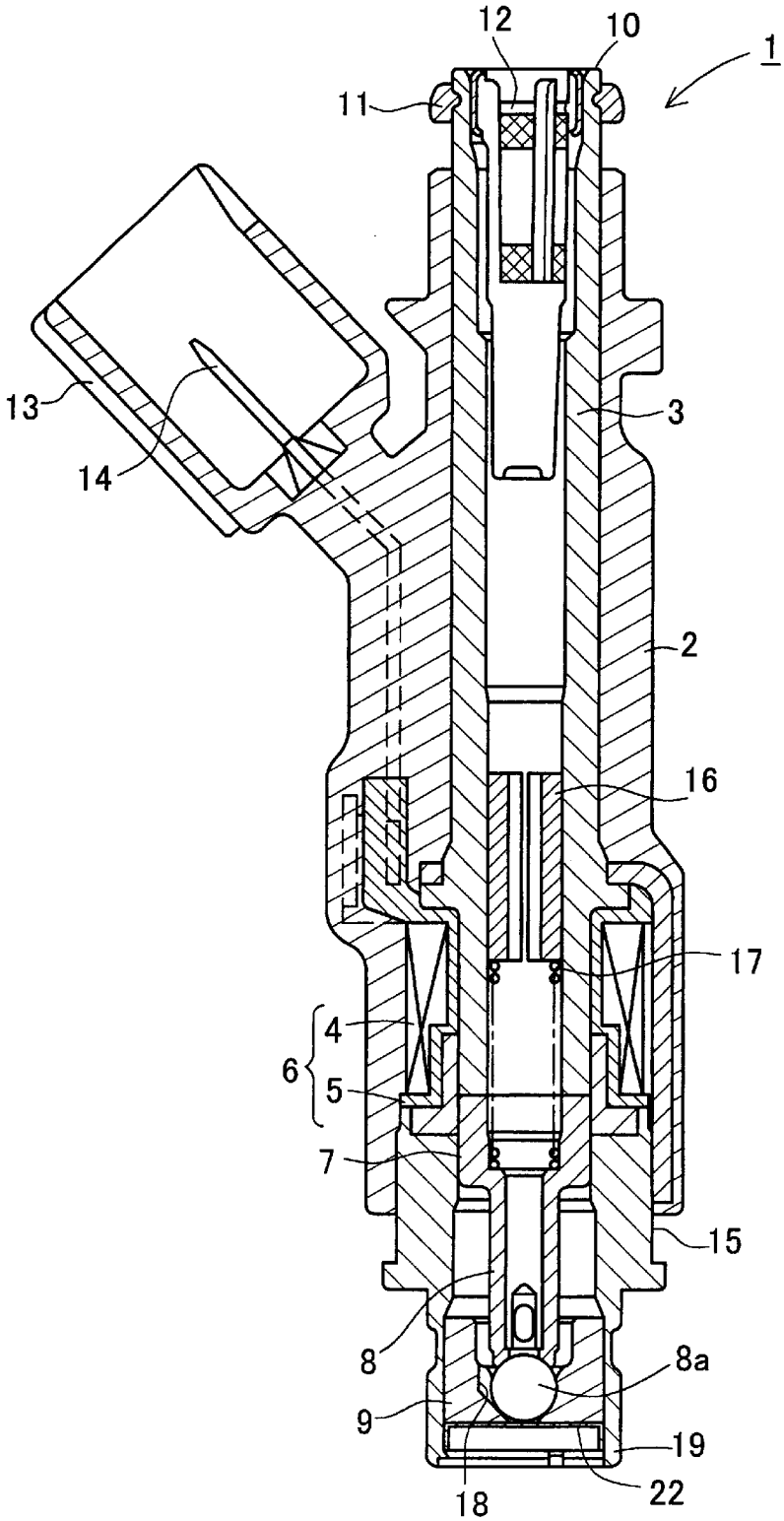
FIG. 1 is a sectional view of an injector to be used in an engine in a preferred embodiment.

FIG. 1 is a longitudinal sectional view of an electromagnetic fuel injection valve (injector) 1 which is used in an engine. This injector 1 is basically provided with a fuel receiving pipe 3 provided in a housing 2, a solenoid 6 constructed of a conducting wire 4 and a bobbin 5, a movable core 7 which is vertically movable by magnetization and demagnetization of the solenoid 6, a needle 8 formed integrally with the movable core 7 and provided with a spherical valve body 8 at the tip thereof, a body 9 surrounding the tip of the needle 8, and a holder 15 internally holding the movable core 7, the needle 8, and the body 9.

The upper end of the fuel receiving pipe 3 forms a connector 10 which is connected to a delivery pipe (not shown). An O-ring 11 is attached around the connector 10. A filter 12 is fit in the connector 10. An electrical connector 13 for connection with wiring is integrally formed with the upper part of the housing 2. A terminal 14 of the electrical connector 13 is connected to the solenoid 6.

An inner pipe 16 is mounted in the fuel receiving pipe 3 and a coil spring 17 is disposed between the inner pipe 16 and the movable core 7. This coil spring 17 urges the movable core 7 downward to close the valve body 8*a* of the needle 8.

At the lower part of the body 9, namely, at the tip of the injector 1, a fuel passage hole 18 is formed. The end of the holder 15 forms a sleeve 19 with this hole 18 centered. An orifice plate 21 mentioned later (see FIG. 2 and other figures) is fixed between the sleeve 19 and the body 9 by means of the plate holder 22.

Figure 2:
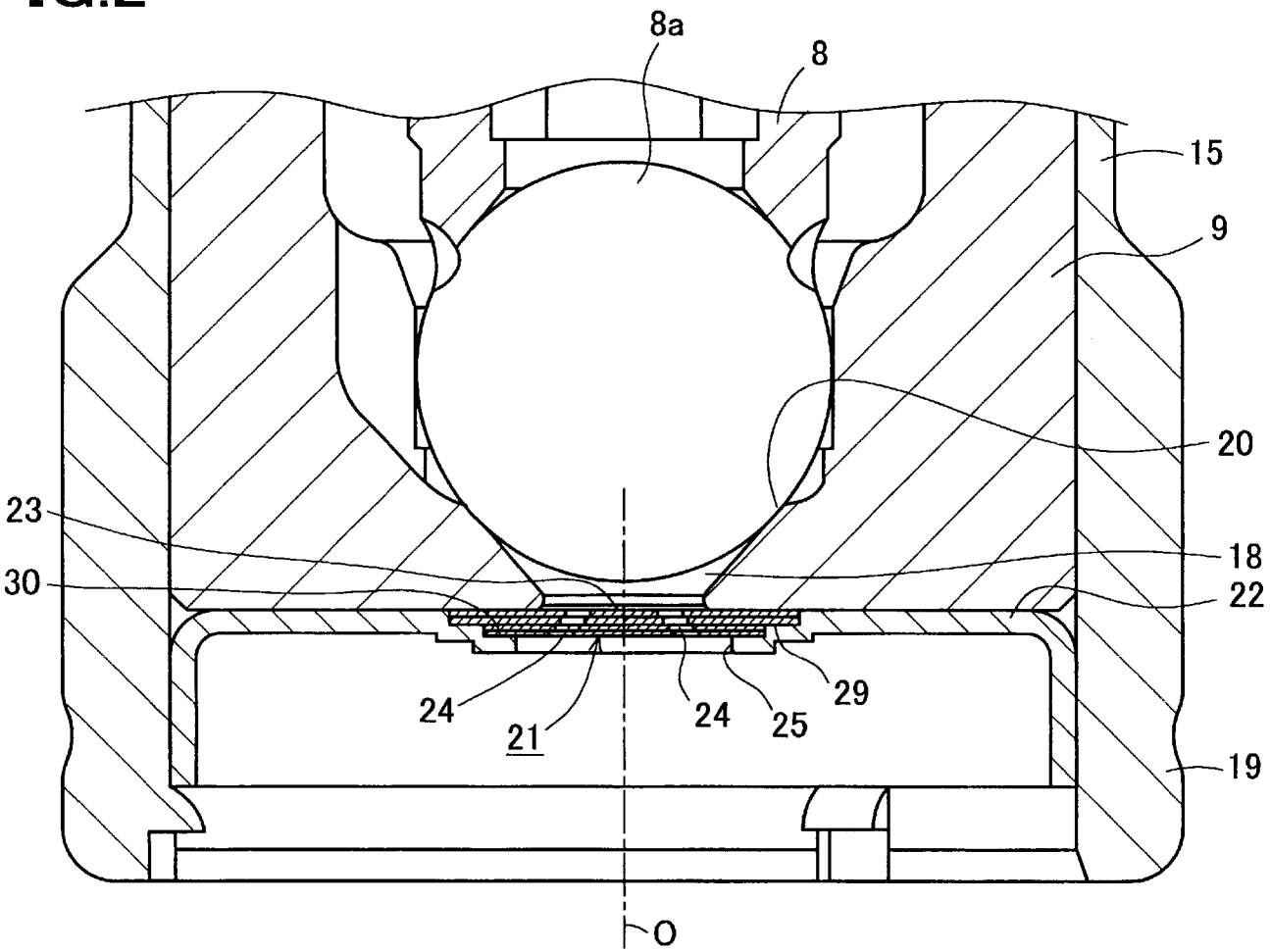
FIG. 2 is an enlarged sectional view of a tip part of the injector.

FIG. 2 shows an enlarged sectional view of the tip of the injector 1. The periphery of the fuel passage hole 18 being open toward the tip side of the body 9 forms a seat 20 on which the valve body 8*a* is seated for the valve closed time. At the tip of the body 9, the orifice plate 21 is fixed to cover the fuel passage hole 18 from its front side (lower side in FIG. 2). The orifice plate 21 is pressed against the tip of the body 9 and fixed thereto. Specifically, this orifice plate 21 is welded to the body 9 by laser welding. The sleeve 19 is formed extending from the tip of the body 9 to cover the periphery of the plate holder 22.

The orifice plate 21 is constructed of a single plate body 23 (see FIG. 4), which will be mentioned later in detail, folded into four layers. This orifice plate 21 is formed with a plurality of orifices 24 for allowing the fuel flowing through the fuel passage hole 18 to be injected. The plate holder 22 includes an injection hole 25 at the center thereof. The orifices 24 of the orifice plate 21 are positioned to be present within the injection hole 25. This injection hole 25 is disposed in the sleeve 19.

Figure 3:
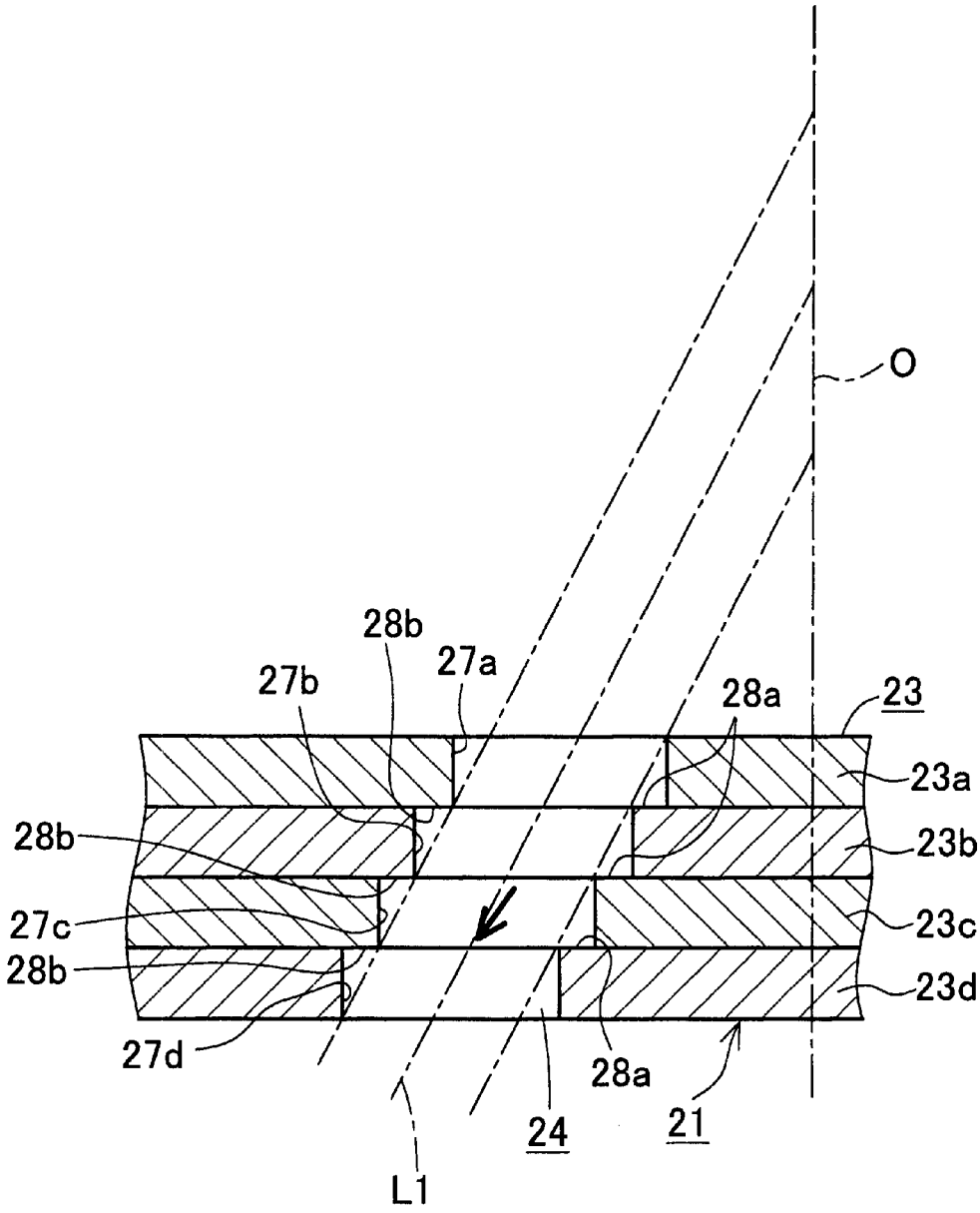
FIG. 3 is an enlarged sectional view of one of orifices.

FIG. 3 is an enlarged sectional view of part of the plate body 23, showing one of the orifices 24. This orifice 24 is constituted of plural holes (four holes in the present embodiment) 27*a*, 27*b*, 27*c*, and 27*d* which are punched or pierced in the plate body 23 so that each hole is perpendicular to the surface of the plate body 23 and are allowed to communicate with one another in a folded state of the plate body 23. The four holes 27*a* to 27*d* communicating with one another are disposed along a line L1 obliquely intersecting the plate body 23 with displacements from one another. In this case, the intersecting line L1 is inclined to the center axis O of the fuel passage hole 18 to widen toward the lower side. In the present embodiment, four lines L1 obliquely intersecting the plate body 23 in section are provided and, along each line L1, plural holes 27*a* to 27*d* are arranged. Accordingly, four orifices 24 are formed extending in different oblique directions. Thus, the injecting directions of the orifices 24 are different from one another as shown in FIG. 2. It is to be noted that only two of the four orifices 24 are shown in FIG. 2. In each orifice 24, the four holes 27*a* to 27*d* are disposed so that their respective centers are displaced outward stepwise from the one nearest the tip of the injector 1 (body 9).

As shown in FIG. 3, respective centers of the four holes 27*a* to 27*d* forming each orifice 24 deviate gradually in a centrifugal direction. Accordingly, the four holes 27*a* to 27*d* are provided with inner minute steps 28*a* each formed on each superposed surface of the plate body 23, that is, on a connected portion between the hole 27*a* and the hole 27*b*, a connected portion between the hole 27*b* and the hole 27*c*, and a connected portion between the hole 27*c* and the hole 27*d*. With these inner minute steps 28*a*, the inside of the orifice 24 becomes partially narrower in a fuel injecting direction. On the other hand, inner minute steps 28*b* opposite to the steps 28*a* partially widen the inside of the orifice 24 in the fuel injecting direction (indicated by an arrow in FIG. 3).

Figure 4:
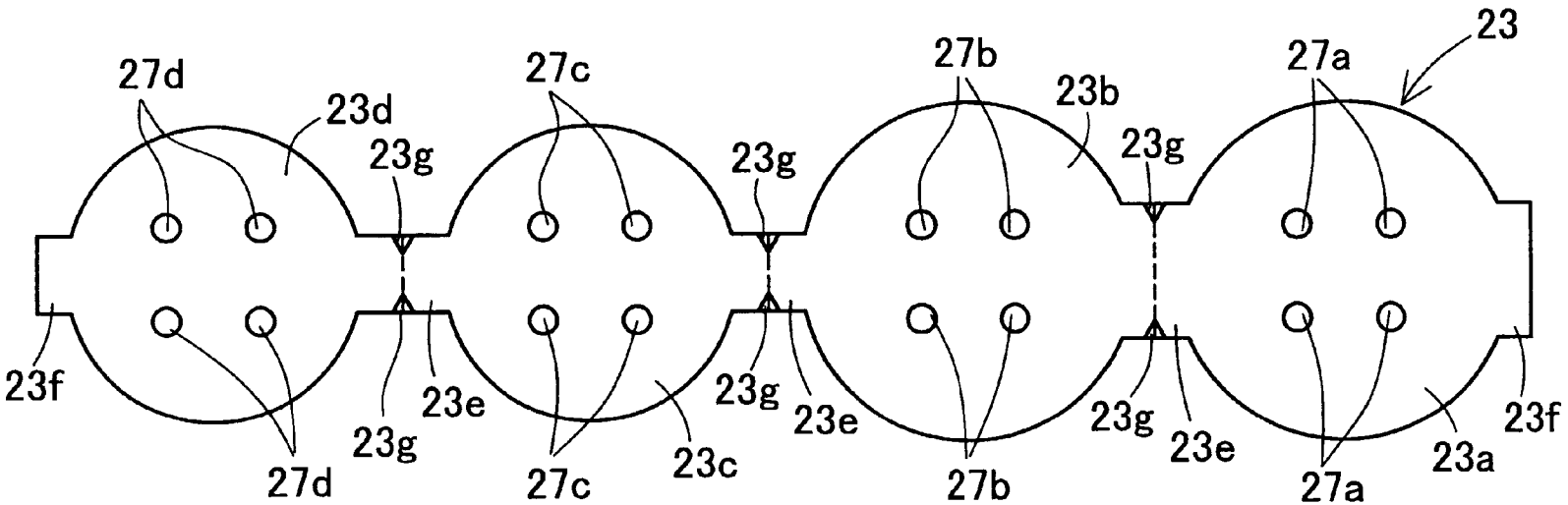
FIG. 4 is a plane view of a plate body in an unfolded state.

FIG. 4 shows a plane view of the plate body 23 in an unfolded state before being folded into a layered state to constitute the orifice plate 21. The plate body 23 includes two large-diameter disks 23*a* and 23*b* and two small-diameter disks 23*c* and 23*d*, which are superposed on top of one another in layers, a plurality of joint parts 23*e* which join adjacent two each among the disks 23*a* to 23*d* and are folded to superpose the disks 23*a* to 23*d*, and two projections 23*f* one each provided in the disks 23*a* and 23*d* disposed at both end sides. The plate body 23 is press-molded as a unit from a metal for example SUS 304. In each disk 23*a*, 23*b*, 23*c*, or 23*d*, the four holes 27*a*, 27*b*, 27*c*, or 27*d* are formed at vertexes of an imaginary square centering on the center of each disk. Those holes 27*a*, 27*b*, 27*c*, or 27*d* in each disk 23*a*, 23*b*, 23*c*, or 23*d* coordinate with the holes 27*a*, 27*b*, 27*c*, or 27*d* correspondingly positioned in other disks. In each joint part 23*e*, cutouts 23*g* are provided in both sides thereof to facilitate folding of each joint part 23*e*.

Figure 5:
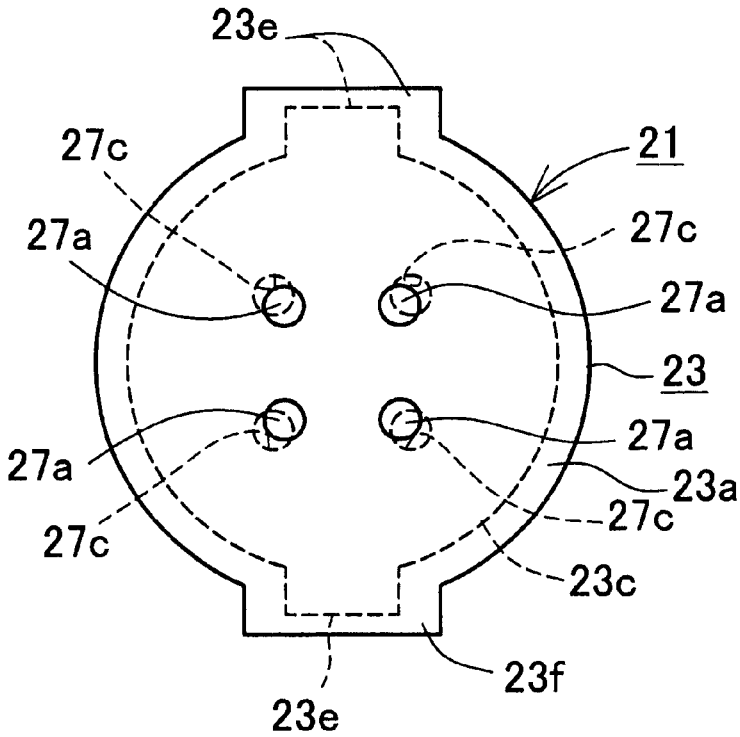
FIG. 5 is a plane view of the plate body in a folded state.
Figure 6:
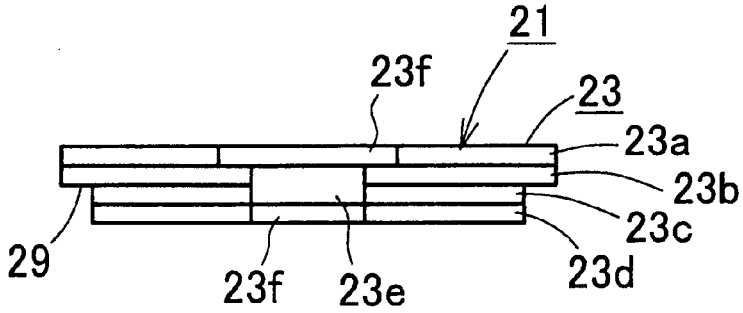
FIG. 6 is a front view of the plate body of FIG. 5.

FIG. 5 shows the plate body 23 in the folded state, namely, a plane view of the orifice plate 21. FIG. 6 is a front view of the orifice plate 21 of FIG. 5. The plate body 23 in the folded state is provided with a circumferential stepped part 29 between the large-diameter disks 23*a* and 23*b* and the small-diameter disks 23*c* and 23*d*. The folded joint parts 23*e* and the projections 23*f* project outward from the circumferential edges of the disks. The holes 27*a* to 27*d* of the disks 23*a* to 23*d* are disposed on top of one another with displacements from one another.

Figure 7:
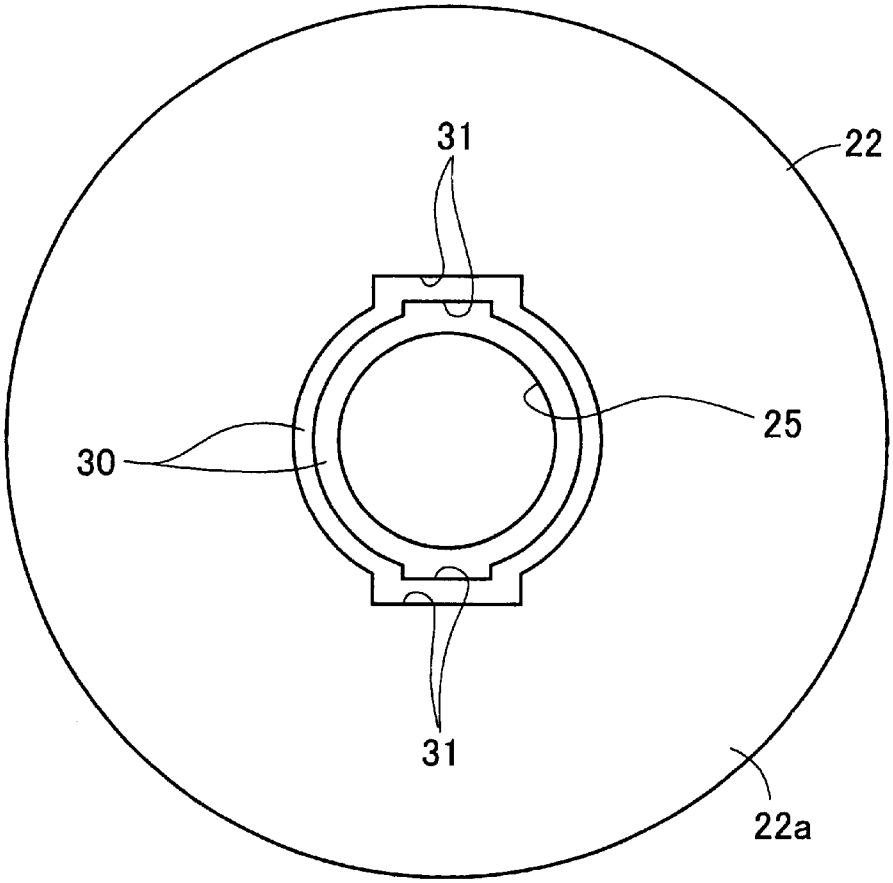
FIG. 7 is a plane view of a plate holder, showing a top thereof.
Figure 8:
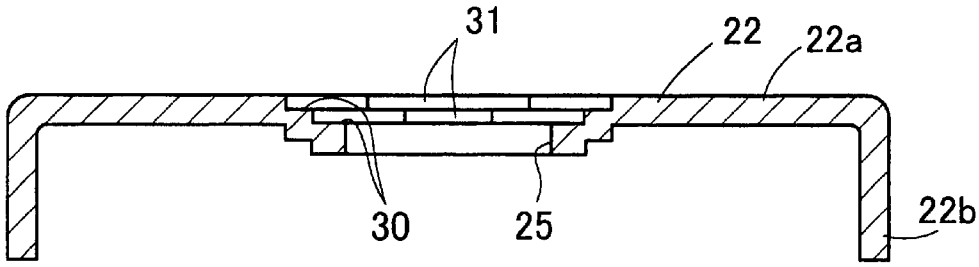
FIG. 8 is a sectional view of the plate holder.

FIG. 7 is a plane view of the plate holder 22, showing the upper side thereof. FIG. 8 is a sectional view of the plate holder 22. This plate holder 22 has substantially a upside down cup shape having a small depth (height) with a circular disk shaped bottom wall 22*a* and a peripheral wall 22*b* formed continuous downward (in FIG. 8) from the bottom wall 22*a*. The plate holder 22 includes, on its upper surface in FIG. 8, stepped parts 30 engageable with the outer peripheries of the large-diameter disks 23*a* and 23*b* and the small-diameter disks 23*c* and 23*d* and their stepped parts 29, and recesses 31 engageable with the folded joint parts 23*e*. The plate holder 22 is provided at its center with the injection hole 25 mentioned above. These stepped parts 30 and recesses 31 are made by a method of punching a plate up to half of the thickness thereof (i.e., a half-punching method).

Figure 9:
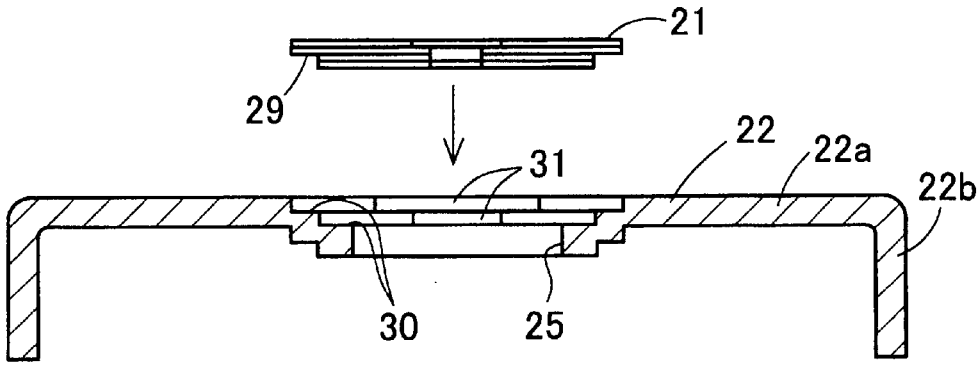
FIG. 9 is an explanatory view to show how to mount an orifice plate in the plate holder.
Figure 10:
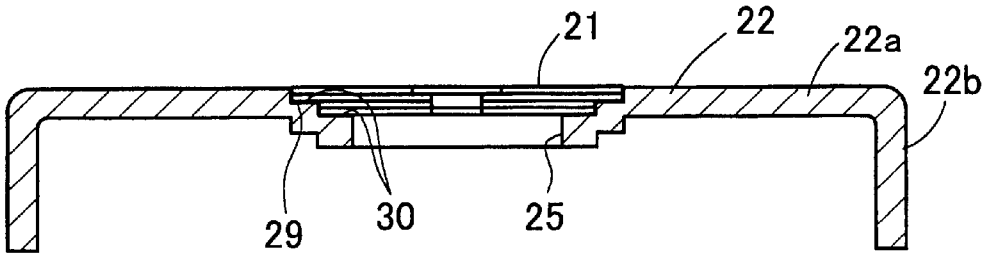
FIG. 10 is a sectional view of the plate holder on which the orifice plate is mounted.
Figure 11:
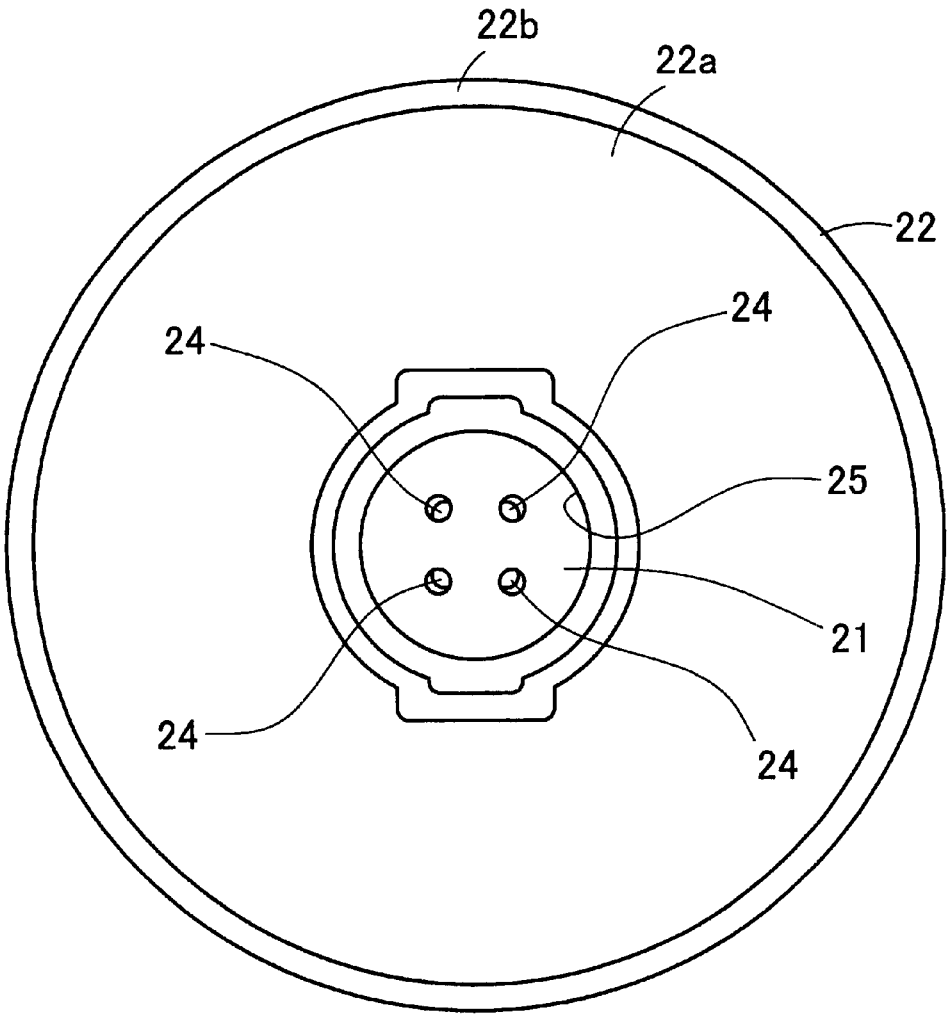
FIG. 11 is a bottom view of the plate holder on which the orifice plate is mounted.

For fixing the orifice plate 21 constructed in layers of the folded plate body 23 at the tip of the injector 1 (the body 9), the orifice plate 21 is, as shown in FIGS. 9 and 10, fit in the plate holder 22 so that the joint parts 23*e* and the projections 23*f* of the disks 23*a* to 23*d* are engaged in the recesses 31. FIG. 11 is a view of the plate holder 22 seen from below in a state where the orifice plate 21 is fit as shown FIG. 10. Inside of the injection hole 25, the orifices 24 of the orifice plate 21 are disposed without interfering with the plate holder 22. The plate holder 22 with the orifice plate 21 fit therein is mounted in the sleeve 19, placed at the tip of the injector 1 (the body 9), and laser-welded thereto. Thus, as shown in FIG. 2, the orifice plate 21 is fixedly pressed against the tip of the body 9 by the plate holder 22 and fixedly held therein.

The injector 1 in the present embodiment, as described above, is attached to an intake air manifold of an engine. A wire such as a feeder wire, a signal wire, or the like is connected to the electrical connector 13 of the injector 1. A delivery pipe is connected to the connector 10 for receiving fuel. When the solenoid 6 is magnetized in a state where fuel is supplied from the delivery pipe to the fuel receiving pipe 3 of the injector 1, the needle 8 as well as the movable core 7 is operated to compress the coil spring 17, thereby allowing the valve body 8*a* to be separated from the seat 20 into a valve open state. During this valve open time, the fuel is allowed to flow from the fuel receiving pipe 3 to the body 9, the clearance between the valve body 8*a* and the seat 20, and the fuel passage hole 18, and then the fuel is injected through the plural orifices 24.

At this time, the fuel passing through the orifices 24 at a downward inclined angle with respect to a radial direction is injected in the directions spreading out in a substantially pyramid or conical shape. In passing each orifice 24, the inner steps 28*a* and therefore the flow of fuel becomes turbulent. This turbulent fuel flow prompts atomization of the fuel to be sprayed, so that the fuel becomes easy to burn.

In the present embodiment, each orifice 24 in the orifice plate 21 is constructed of the plurality of holes 27*a* to 27*d* each perpendicularly punched in the plate body 23, which is folded so that the holes 27*a* to 27*d* are disposed in communication with one another and with stepwise displacements with respect to one another along the line L1 obliquely intersecting the plate body 23. Accordingly, four lines L1 obliquely intersecting the plate body 23 are provided extending in different directions and, along each line L1, the plurality of holes 27*a* to 27*d* are disposed to constitute each orifice 24, so that four orifices 24 are provided in different injecting directions. For forming each orifice 24, the plurality of holes 27*a* to 27*d* have only to be punched in the plate body 23 in a perpendicular direction to the surface of the plate body 23. These holes 27*a* to 27*d* can be punched in a single punching operation by means of a punching device and the like at the same time when the plate body 23 is press-molded as shown in FIG. 4. The orifice plate 21 in the present embodiment, specifically, does not need to be machined to punch the holes 27*a* to 27*d* in an oblique direction with respect to the plate body 23. Thus, the orifice plate 21 can be easily manufactured. In addition, the forming of the plural orifices 24 in different inclined directions does not require to punch the plurality of holes 27*a* to 27*d* individually, which prevents the number of steps of punching from being increased. According to the orifice plate 21 in the present embodiment, therefore, the fuel can be injected through the four orifices 24 respectively in different oblique directions and the machining thereof can be facilitated, resulting in an increased productivity.

According to the orifice plate 21 in the present embodiment, the plural holes 27*a* to 27*d* communicated with one another, forming each orifice 24, are displaced outward stepwise from the one nearest the tip of the injector 1, namely, the body 9. Thus, the fuel can be injected through each orifice 24 in an oblique direction to a centrifugal direction. The fuel injected through the four orifices 24 can be radially widened with respect to the central axis O of the fuel passage hole 18, namely, the central axis of the injector 1, thereby achieving diffusion of the injected fuel.

In the injector 1 in the present embodiment, the orifice plate 21 is held at the tip of the injector 1 (the body 9) by the plate holder 22. Accordingly, as compared with the case where the orifice plate is attached by itself to the tip of the injector, the orifice plate 21 can surely be fixed to the body 9 against the fuel pressure. Furthermore, the fuel injected through the four orifices 24 of the orifice plate 21 passes through the injection hole 25 of the plate holder 22 and is discharged outside the injector 1. The fuel injected through each orifice 24 can be prevented from being obstructed by the plate holder 22 and therefore the desired injection characteristics, for example, the injecting stream direction and shape through each orifice 24, can be ensured.

According to the injector 1 in the present embodiment, the plate body 23 folded at the joint parts 23*e* is provided with the stepped parts 29 at the outer peripheries of the large-diameter disks 23*a* and 23*b* and the small-diameter disks 23*c* and 23*d* when superposed on top of one another. The orifice plate 21 is fit in the plate holder 22 so that the stepped parts 29 of the orifice plate 21 are engaged in the stepped parts 30 of the plate holder 22. Thus, the orifice plate 21 can be held in place without rotating. This makes it possible to prevent rotation of the orifice plate 21 even when the pressure of fuel to be injected acts on the plate 21 and change in inclination of fuel to be sprayed through each orifice 24. As a result, the injecting direction from the orifice plate 21 can be prevented from being changed improperly. Specifically, the direction of fuel to be injected through each orifice 24 of the orifice plate 21 can stably be held.

The present invention may be embodied in other specific forms without departing from the spirit or essential characteristics thereof. For instance, the following alternatives can be adopted.

In the above embodiment, as shown in FIG. 2, the orifice plate 21 is fixed to the body 9 in the inside of the sleeve 19 disposed at the tip of the injector 1 by means of the orifice plate 21. An alternative design is to fix the orifice plate 21 to the body 9 by only the plate holder 22 without using the sleeve 19. Furthermore, the orifice plate 21 may be fixed by itself to the injector (body) without using the plate holder. In any case, the same effects as in the above embodiment can be obtained.

Figure 12:
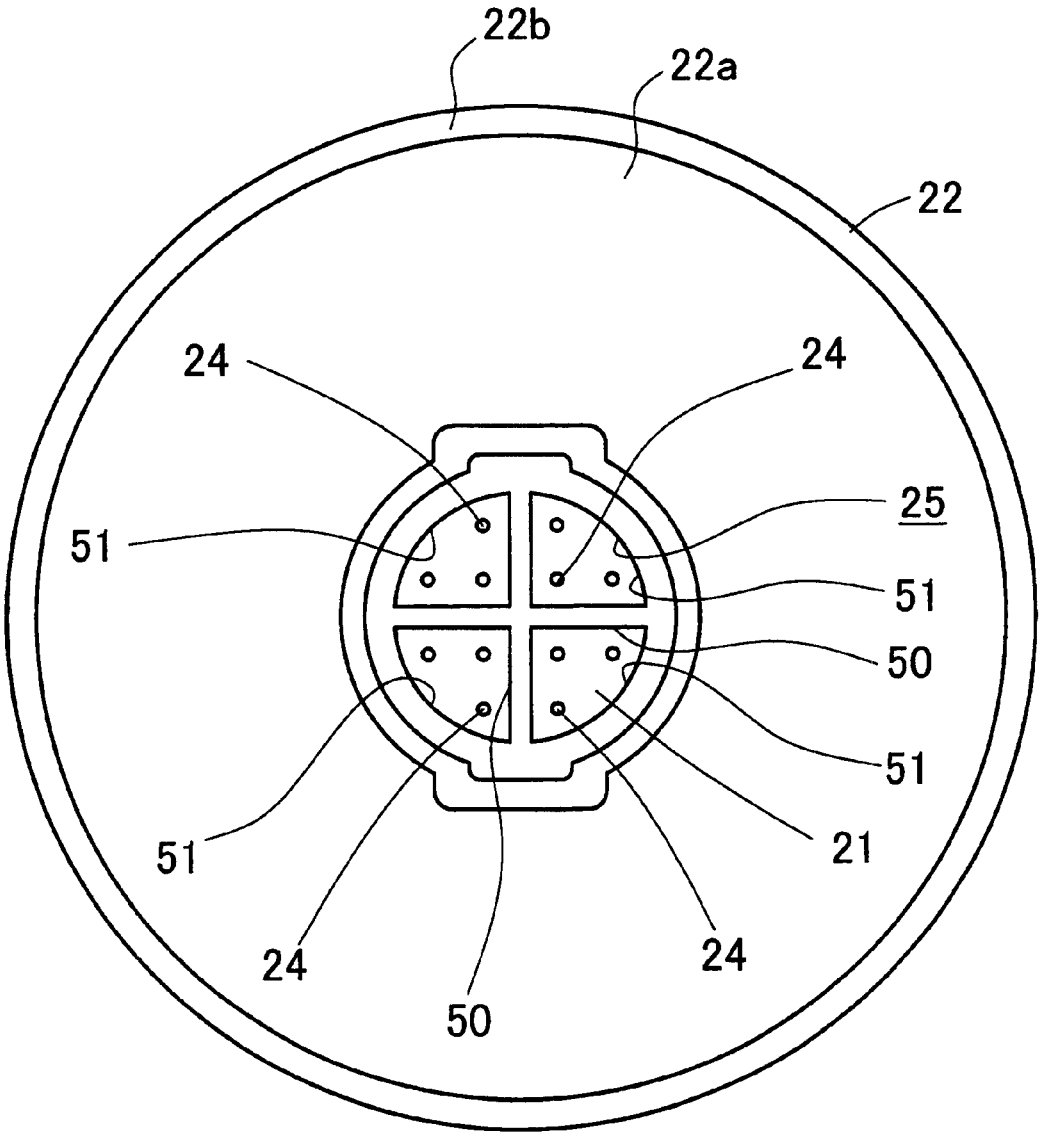
FIG. 12 is a modified example of the plate holder of FIG. 11.
Figure 13:
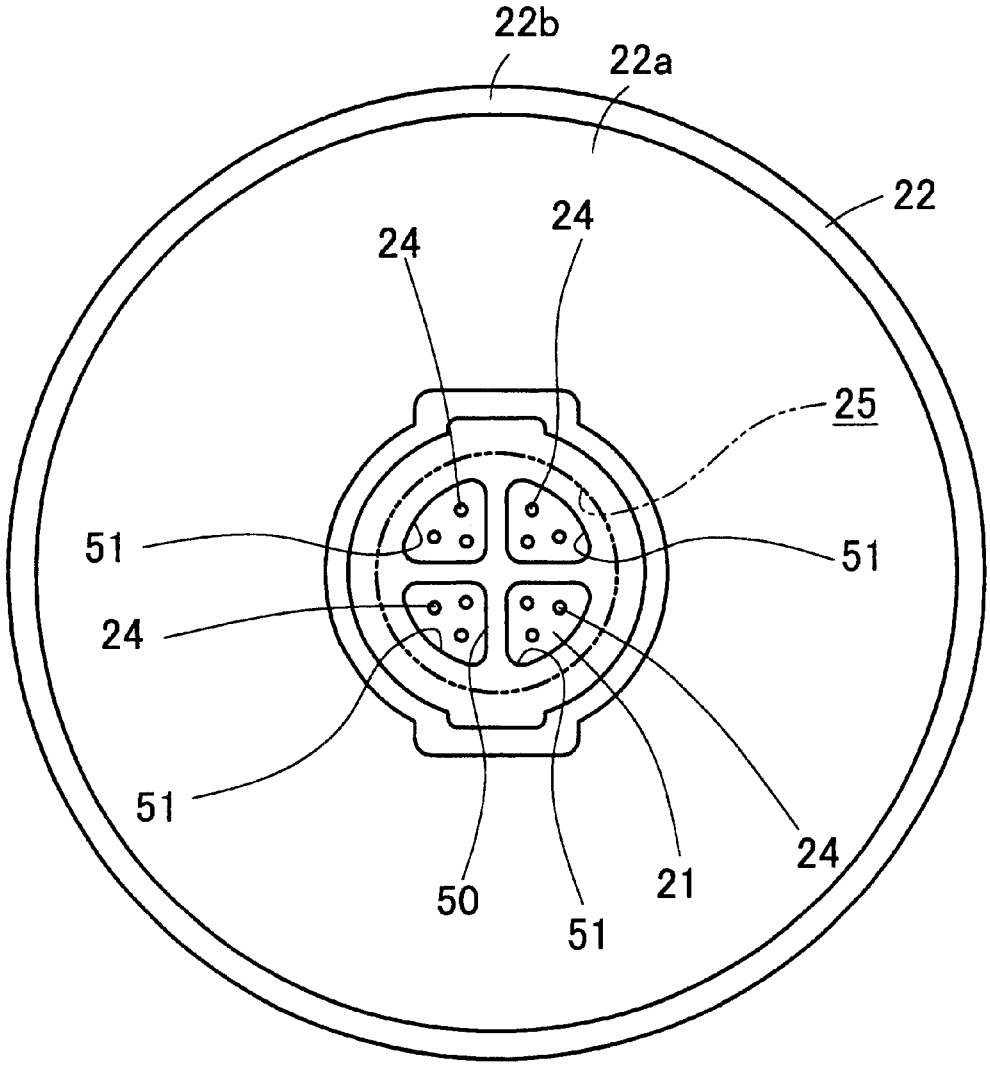
FIG. 13 is a modified example of the plate holder of FIG. 11.
Figure 14:
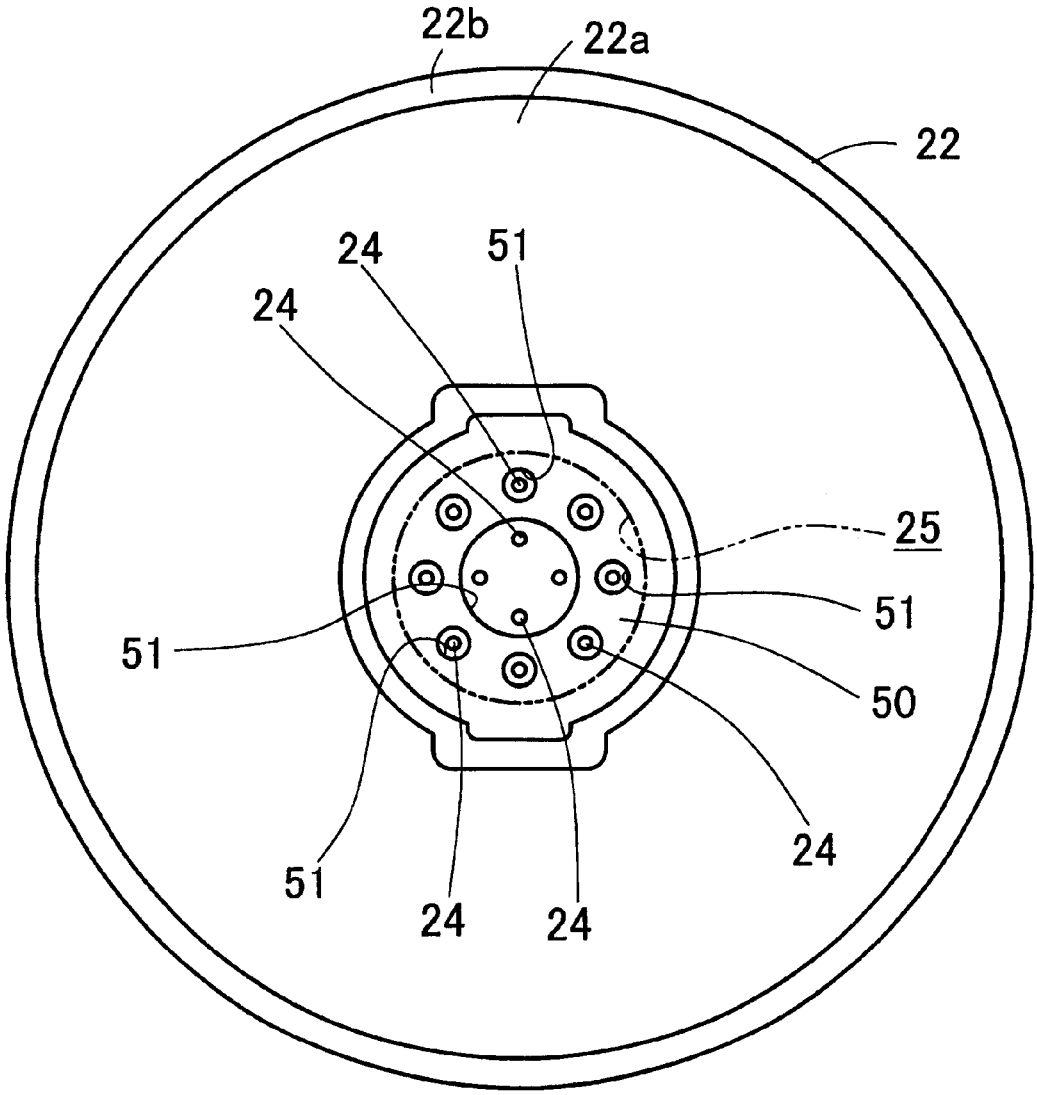
FIG. 14 is a modified example of the plate holder of FIG. 11.
Figure 15:
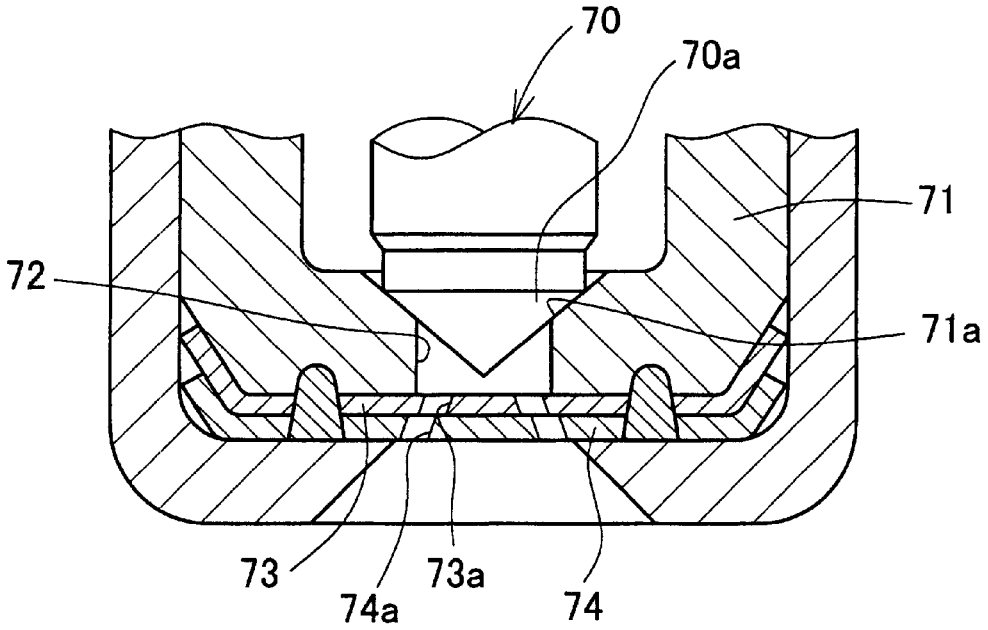
FIG.15 PRIOR ART
FIG. 15 is a sectional view of a tip end of an injector in a prior art.
Figure 16:
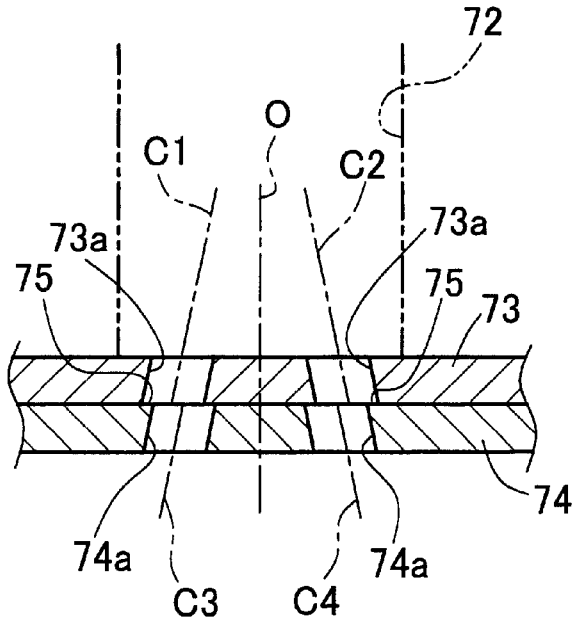
FIG.16 PRIOR ART
FIG. 16 is an enlarged sectional view of orifice plates in the prior art.
Figure 17:
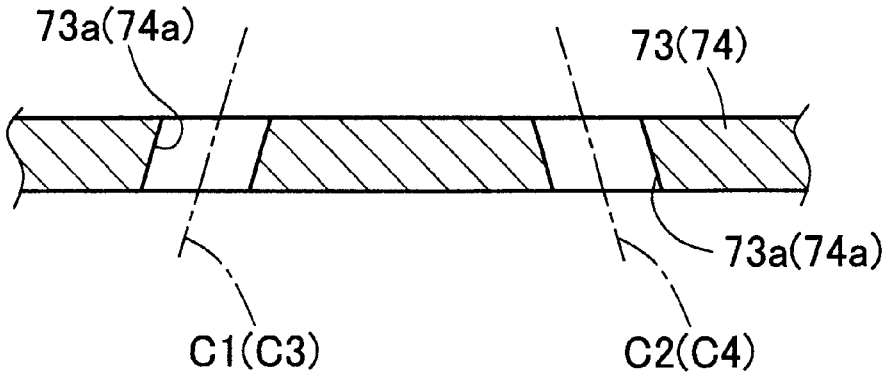
FIG.17 PRIOR ART
FIG. 17 is a sectional view of one of the plates including an orifice in the prior art.

In the above embodiment, as shown in FIG. 11, the orifice plate 21 is exposed in an entire area of the injection hole 25 of the plate holder 22. Alternatively, the plate holder 22 may be constructed to have reinforcing ribs 50 disposed in the injection hole 25 so that the plurality of orifices 24 of the orifice plate 21 are positioned within openings 51 defined by the reinforcing ribs 50 as shown in FIGS. 12 to 14 respectively. In this case, the orifice plate 21 is held by the reinforcing ribs 50 in the injection hole 25 of the plate holder 22. Therefore, the orifice plate 21 can be prevented from being deformed due to the pressure of fuel at injection and can maintain the stable injection characteristics.

In the above embodiment, four orifices 24 are provided in the orifice plate 21 so that each orifice 24 is placed at each vertex of a square. As shown in FIGS. 12 to 14, alternatively, the number of orifices 24 may be changed to any number other than four and also their respective positions may be changed from the vertexes of the square.

Instead of the plurality of orifices 24 in the above embodiment, furthermore, a single orifice 24 may be provided in the orifice plate 21.

In the above embodiment, the plate body 23 constituting the orifice plate 21 is constructed of the disks which are different in diameter, namely, the large-diameter disks 23*a* and 23*b* and the small-diameter disks 23*c* and 23*d*. An alternative design is the use of the plate body 23 including disks all of which are equal in diameter. In this case, the joint parts 23*e* and the projections 23*f* described in the above embodiment are formed in an identical shape.

The plate body 23 in the above embodiment is constructed of the integrally formed large-diameter disks 23*a* and 23*b*, small-diameter disks 23*c* and 23*d*, joint parts 23*e*, and others, and is folded at the joint parts 23*e* so that the disks 23*a* to 23*d* are superposed on top of one another, thereby forming the orifice plate 21. Alternatively, the orifice plate 21 may be constituted of large-diameter disks and small-diameter disks which are separately formed and superposed on top of one another.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. An orifice plate which is mounted at a tip of an injector to cover a fuel passage hole formed at the tip, the orifice plate including:

a plate body constructed in layers; and an orifice for allowing fuel having gassed through the fuel passage hole to be injected; wherein the orifice is constructed of a plurality of holes each formed in each layer of the plate body so that each hole is perpendicular to a surface of the plate body, the holes being disposed in communication with each other and with displacements from each other along a line obliquely intersecting the plate body, and wherein the plate body includes a plurality of disks which are superposed on top of each other and a joint part which joins the adjacent disks in an unfolded state and is folded to construct the layered plate body.

2. The orifice plate according to claim 1, wherein the plurality of holes communicated with each other are displaced outward stepwise from one nearest the tip of the injector.

3. The injector provided with the orifice plate according to claim 1, wherein the injector includes a plate holder provided with an injection hole, the orifice plate is fixedly pressed against the tip of the injector by means of the plate holder and the orifice is positioned within the injection hole, and the plate holder includes a recess engageable with the joint part of the orifice plate in a folded state.

4. The injector according to claim 3, wherein the plate holder includes a reinforcing rib positioned in the injection hole and an opening defined by the reinforcing rib so that the orifice is positioned within the opening.

5. An orifice plate which is mounted at a tip of an injector to cover a fuel passage hole formed at the tip, the orifice plate including:

a plate body constructed in layers; and an orifice for allowing fuel having passed through the fuel passage hole to be injected;

wherein the orifice is constructed of a plurality of holes each formed in each layer of the plate body so that each hole is perpendicular to a surface of the plate body, the holes being disposed in communication with each other and with displacements from each other along a line obliquely intersecting the plate body, and wherein the plate body includes a large-diameter disk and a small-diameter disk which are superposed on top of each other and a joint part which joins the disks and is folded, the disks in a superposed state providing a stepped part on an outer periphery of the plate body.

6. The injector provided with the orifice plate according to claim 5, wherein the injector includes a plate holder provided with an injection hole, the orifice plate is fixedly pressed against the tip of the injector by means of the plate holder and the orifice is positioned within the injection hole, and the plate holder includes a stepped part engageable with the stepped part provided between the large-diameter disk and the small-diameter disk and a recess engageable with the joint part of the orifice plate in a folded state.

7. The injector according to claim 6, wherein the plate holder includes a reinforcing rib positioned in the injection hole and an opening defined by the reinforcing rib so that the orifice is positioned within the opening.

8. The orifice plate according to claim 5, wherein the plurality of holes communicated with each other are displaced outward stepwise from one nearest the tip of the injector.

* * * * *